US006590371B2

(12) United States Patent
Sirito-Olivier

(10) Patent No.: US 6,590,371 B2
(45) Date of Patent: Jul. 8, 2003

(54) CURRENT SOURCE ABLE TO OPERATE AT LOW SUPPLY VOLTAGE AND WITH QUASI-NULL CURRENT VARIATION IN RELATION TO THE SUPPLY VOLTAGE

(75) Inventor: Philippe Sirito-Olivier, Par Martigues (FR)

(73) Assignee: STMicroelectronics S.A., Montrouge (FR)

( * ) Notice: Subject to any disclaimer, the term of this patent is extended or adjusted under 35 U.S.C. 154(b) by 0 days.

(21) Appl. No.: 10/082,785

(22) Filed: Feb. 25, 2002

(65) Prior Publication Data

US 2002/0145411 A1 Oct. 10, 2002

(30) Foreign Application Priority Data

Feb. 26, 2001 (FR) ..... 01 02579

(51) Int. Cl.[7] ..... G05F 3/16
(52) U.S. Cl. ..... 323/315
(58) Field of Search ..... 323/312, 315, 323/317; 330/257, 288; 327/535, 538

(56) References Cited

U.S. PATENT DOCUMENTS

| | | | | |
|---|---|---|---|---|
| 4,563,632 A | * | 1/1986 | Palara et al. | 323/316 |
| 4,605,892 A | | 8/1986 | Seevinck et al. | 323/315 |
| 5,038,053 A | | 8/1991 | Djenguerian et al. | 307/310 |
| 5,506,543 A | * | 4/1996 | Yung | 330/253 |
| 6,128,172 A | | 10/2000 | Feldtkeller | 361/93.8 |
| 6,465,998 B2 | * | 10/2002 | Sirito-Olivier | 323/315 |

FOREIGN PATENT DOCUMENTS

| | | | |
|---|---|---|---|
| DE | 19705338 | 6/1998 | H01L/23/62 |
| EP | 0472202 | 2/1992 | G05F/3/26 |
| EP | 0524498 | 1/1993 | G05F/3/30 |

OTHER PUBLICATIONS

Gray et al., 1942, *Analysis and Design of Analog Integrated Circuits*, Third Edition, University of California, Berkeley, Copyright 1977, 1984, 1993 by John Wiley & Sons, Chapter 4, p. 324.

* cited by examiner

*Primary Examiner*—Matthew Nguyen
(74) *Attorney, Agent, or Firm*—Lisa K. Jorgenson; Allen, Dyer, Doppelt, Milbrath & Gilchrist, P.A.

(57) ABSTRACT

A current source includes a current mirror and a core connected together between two supply terminals. The current mirror comprises a pilot transistor and first and second recopy transistors. The core comprises first and second transistors and a resistance. The first transistor and the first recopy transistor are connected together to form a first branch. The resistance and the second recopy transistor are connected together to form a second branch. The pilot transistor and the second transistor are connected together to form a third branch. These branches are connected between the two supply terminals. The first transistor is linked to the second branch between the resistance and the second recopy transistor. The second transistor is connected to the first branch between the first core transistor and the first recopy transistor.

33 Claims, 3 Drawing Sheets

CURRENT SOURCE ABLE TO OPERATE AT LOW SUPPLY VOLTAGE AND WITH QUASI-NULL CURRENT VARIATION IN RELATION TO THE SUPPLY VOLTAGE

FIELD OF THE INVENTION

The present invention relates to current sources, and more particularly, to a current source that operates at a low supply voltage and with quasi-null current variation in relation to a supply voltage.

BACKGROUND OF THE INVENTION

Current sources that operate at a low supply voltage and with quasi-null current variation in relation to a supply voltage are used, in particular, for polarizing circuits such as operational amplifiers, for example. These circuits are intended to operate over wide voltage ranges.

For example, one can consider portable devices that may be supplied either from a battery or from a main power supply. These devices can be radio devices, and devices for reading or sound reproduction. When these devices operate on a battery, the supply voltage is relatively low, on the order of 3 volts for example, and diminishes when the battery drains down to about 2 volts or less. When these devices operate from a main power supply, the supply voltage is on the order of 5 volts. There can be a ratio of 2 or even 3 between the two supply voltages.

At present the current sources used in this type of application are such as that shown in FIG. 1. This source of current, produced in this example using bipolar technology, is connected between two supply terminals. Terminal 20 is connected to a high potential $V_{CC}$ and the other terminal 21 is connected to a low potential $V_{ee}$, which is generally ground.

The current source comprises a core C and a current mirror M mounted in series between the two supply terminals 20, 21. The core C is the part of the current source which controls an equation corresponding to the source current. In this case, it concerns a so-called $V_{BE}/R$ source. The core C comprises a transistor Q1, a resistance R for setting the current and possibly an additional transistor Q2. The core C is connected to one of the supply terminals 21, in this case the terminal 21 at the potential $V_{ee}$. The transistors Q1 and Q2 of the core are of the same type, in this case of the n-p-n type.

In the description below, a voltage $V_{BE}$ represents a base-emitter voltage and a voltage $V_{CE}$ represents a collector-emitter voltage. The current mirror M comprises a pilot transistor Q5 and at least one recopy transistor Q4. The mirror M is linked to the other supply terminal 20, in this example, the potential $V_{CC}$. The mirror transistors Q4, Q5 are of the same type, in this case of the p-n-p type, and are complementary to those of the core C. They are produced at the same time and are thus identical.

The transistor Q1 is connected between the supply terminal 21 and the recopy transistor Q4 of the mirror M. These two transistors Q1, Q4 form a slave branch 22 between the two supply terminals 20, 21. The base of the transistor Q1 is connected to a first end of the resistance R for current setting. The second end of the resistance R is connected to the supply terminal 21 at the potential $V_{ee}$. The first end of the resistance R is also connected to the pilot transistor Q5 of the mirror M via the additional transistor Q2. The resistance R for setting the current, the additional transistor Q2 and the pilot transistor Q5 form a pilot branch 23 between the two supply terminals 20, 21. The transistor Q1 is configured as a diode, that is, its base is connected to its collector via the additional transistor Q2. The mirror M is connected to the other supply terminal 20, in this case at the potential $V_{CC}$.

The recopy transistor Q4 of the mirror M has its emitter connected to the supply terminal 20 at the potential $V_{CC}$, its collector connected to the transistor O1 of the core C and its base connected to the base of the pilot transistor Q5 of the mirror M. The pilot transistor Q5 of the mirror M has its base connected to the base of the recopy transistor Q4 of the mirror M and to its collector. It is configured as a diode. Its connector is also linked to the resistance R of the core C via the additional transistor Q2. The emitter of the pilot transistor Q5 is connected to the supply terminal 20 at the potential $V_{CC}$.

The biasing current of the source is accessible at the level of the collector of an output transistor Q6, which is configured as a recopy transistor relative to the mirror M. Its emitter is connected to the supply terminal 20 at the potential $V_{CC}$, and its base to the base of the pilot transistor Q5 of the mirror M. The output transistor Q6 is identical to the pilot transistor Q5. This biasing source is described on page 324 of the work "Analysis and Design of Analog Integrated Circuits" by P R GRAY and R. G. MEYER, 3rd Edition.

One can assume that in the core C, the current I crossing the resistance R, and which corresponds to the collector current of the transistor Q2, is the same as that circulating in the branch 22 by current mirror effect. Thus, one has:

$$I=(V_T/R\times \mathbf{1}n(I/I_S)$$

where the thermal voltage $V_T$ equals kT/q, k is Boltzmann constant, T the temperature in degrees Kelvin and q the charge of the electron. $I_S$ represents the saturation current of the transistor Q2.

If I is known, this makes it possible to determine the expression of the polarization current Ic(Q6) of the source at the level of the output transistor Q6:

$$Ic(Q6)=I\times(1+V_{CE}(Q6)/V_{EA}(Q6)/1+V_{CE}(Q5)/V_{EA}(Q5))$$

where $V_{EA}$(Q6) and $V_{EA}$(Q5) are respectively the Early voltages of the transistors Q6 and Q5. They are equal, since the transistors Q6 and Q5 are of the same p-n-p type and are identical. The voltage $V_{CE}$(Q5) is equal to $V_{BE}$(Q5) because the pilot transistor Q5 is configured as a diode. The voltage $V_{BE}$(Q5) remains relatively constant while $V_{CC}$ varies.

The current Ic(Q6) varies in the same direction as the potential difference between the two supply terminals 20, 21 since $V_{CE}$(Q6) varies in the same direction as this potential difference. In the rest of the description below, this potential difference is assimilated to $V_{CC}$ since it has already been assumed that the supply terminal 21 is at a ground potential.

To obtain a biasing current in the opposite direction from the current Ic(Q6), that is, complementary to the current Ic(Q6), one can add a second output transistor Q3 configured as a current mirror with the Q1 transistor of the core. In this second mirror, the transistor Q1 is the pilot transistor and the transistor Q3 is a recopy transistor.

This recopy transistor Q3 has its base connected to the base of the transistor Q1, its emitter connected to the first supply terminal 21 at the potential $V_{ee}$ and its collector forms another source output. The collector current of the transistor Q3 is given by:

$$Ic(Q3)=I\times(1+V_{CE}(Q3)/V_{EA}(Q3))/1+V_{CE}(Q1)/V_{EA}(Q1))$$

$$Ic(Q3)=I\times(1+V_{CE}(Q3)/V_{EA}(Q3))/1+V_{BE}(Q1)+V_{BE}(Q2))/V_{EA}(Q1))$$

$V_{EA}$(Q3) and $V_{EA}$(Q1) are Early voltages of the Q3 and Q1 transistors respectively. They are equal and correspond to the Early voltages of n-p-n transistors since Q1 and Q3 are identical n-p-n transistors. In this case again $V_{BE}$(QL) and $V_{BE}$(Q2) remain relatively constant while $V_{CC}$ varies, but $V_{CE}$(Q3) varies in the same direction as $V_{CC}$, and thus $I_C$(Q3) varies in the same direction as $V_{CC}$.

The properties of electronic circuits biased by a current source are intrinsically linked with the current consumption of their components. For example, the gain of a transistor increases as the current passing therethrough increases. To have properties as constant as possible to control electronic circuits, the biasing current should be as constant as possible regardless of the value of the supply voltage.

The biasing current source of FIG. 1 is not completely satisfactory from this point of view. In addition, this biasing current source only starts up when the supply voltage Vcc reaches a relatively high value. This property is disadvantageous when the supply voltage is provided by a battery which is somewhat discharged, since there is the risk that the biasing current may not start up.

The minimum supply voltage for starting up the current source is given by:

$$V_{CCmin}=V_{BE}(Q1)+V_{BE}(Q2)+V_{CEsat}(Q4)$$

that is, $2V_{BE}+V_{CEsat}$. This equation applies to branch 22. For branch 23:

$$V_{CCmin}=RI+V_{CEsat}(Q2)+V_{BE}(Q5)$$

$$V_{CCmin}=V_{BE}(Q1)+V_{CEsat}(Q2)+V_{BE}(Q5)$$

that is, $V_{CCmin}=2V_{BE}+V_{CEsat}$. This voltage $V_{CCmin}$ is on the order of 1.7 volts with bipolar transistors.

SUMMARY OF THE INVENTION

In view of the foregoing background, an object of the present invention is to overcome the disadvantages presented by the current source illustrated in FIG. 1.

The present invention relates to a current source whose current is almost constant while the supply voltage varies and which, in addition, can start up at a low supply voltage.

More precisely, the present invention relates to a source of current set between two supply terminals. The current source comprises a current mirror and a core connected together. These items are discrete. The current mirror and the core form several branches to be connected between the two supply terminals. The mirror comprises a pilot transistor and at least one recopy transistor. The core comprises a first transistor, a second transistor, and a resistance.

The first core transistor and the first recopy transistor are connected together to form the first branch. The resistance and a second recopy transistor of the mirror are linked together to form the second branch. The pilot transistor and the second core transistor are linked together to form the third branch. The first transistor of the core is connected to the second branch between the resistance and the second recopy transistor. The second core transistor is connected to the first branch between the first core transistor and the first recopy transistor.

An output transistor makes the source current accessible. This transistor is a supplementary recopy transistor of the mirror, but is placed off-branch. The mirror transistors are of the same type, and the same applies to the core transistors. In addition, the core transistors and the mirror transistors are complementary.

The mirror transistors may be bipolar. To compensate for the base currents of the mirror transistors, the pilot transistor of the mirror may be configured as a diode through a supplementary transistor. The mirror transistors may be MOS transistors. In the same way, the core transistors may be bipolar transistors or MOS transistors. The supplementary transistor may be either a bipolar or a MOS transistor.

BRIEF DESCRIPTION OF THE DRAWINGS

Other properties and advantages of the invention will become clear by reading the following description which refers to the attached figures.

DETAILED DESCRIPTION OF THE PREFERRED EMBODIMENTS

Figure 1:
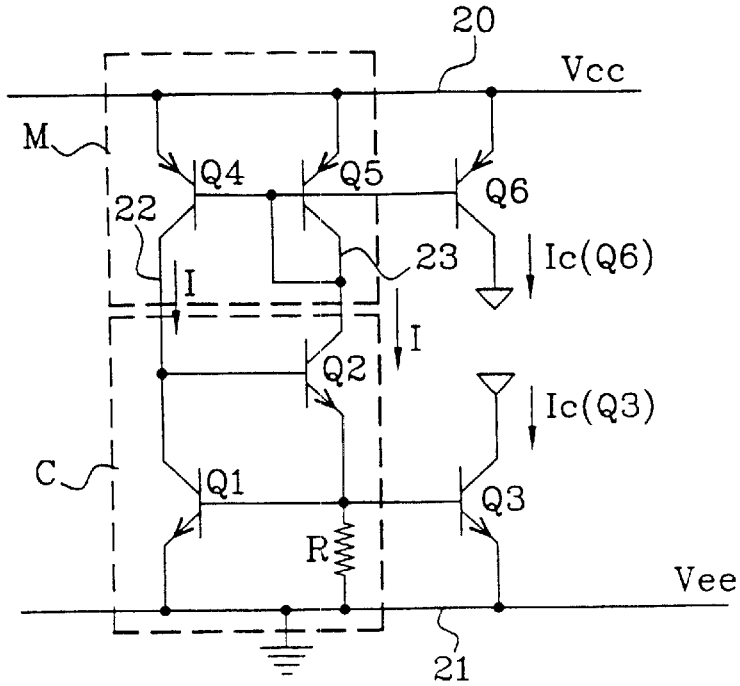
Fig. 1 (PRIOR ART)
FIG. 1 is an electrical diagram of a current source according to the prior art.
Figure 2:
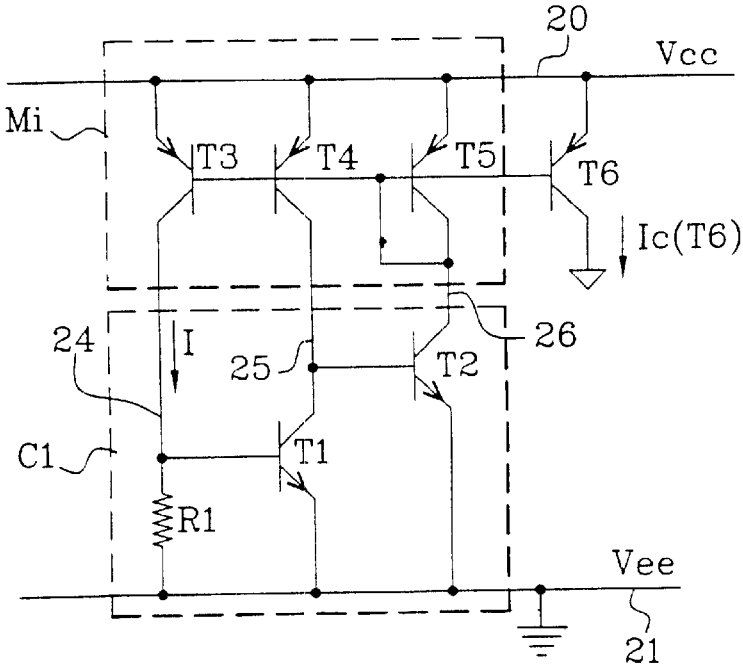
FIG. 2 is an electrical diagram of an example of a current source using bipolar transistors according to the present invention.

Referring now to FIG. 2, there are two supply terminals 20 and 21 as in FIG. 1. One terminal is at the high potential $V_{CC}$ and the other terminal is at the low potential $V_{ee}$, which is generally ground. When referring to the supply voltage, it concerns the potential difference between the potential $V_{CC}$ of the supply terminal 20 and the potential $V_{ee}$ of the supply terminal 21. In this case, it concerns $V_{CC}$ since it is assumed that the supply terminal 21 is at a ground reference.

The current source comprises several branches 24, 25, 26, with each branch being mounted between the two supply terminals. This current source includes, as in the prior art, a core C1 and a current mirror Mi discrete from the core C1. The mirror Mi and the core C1 are connected together. They will now be described in detail to demonstrate the difference relative to the prior art.

The core C1 is connected to one of the supply terminals 21, in this case the supply terminal at the potential $V_{ee}$. The core C1 is formed of a resistance R1 for setting the current and two transistors T1, T2 of the same type. Each of these elements belongs to a different branch.

The current mirror Mi is connected to the other supply terminal 20, in this case the supply terminal 20 at the potential $V_{CC}$. The current mirror Mi comprises a pilot transistor T5 and two recopy transistors T4 and T3. These three transistors belong to different branches.

The first recopy transistor T4 and the first transistor T1 of the core C1 are connected together to form the first branch 25. The second recopy transistor T3 and the resistance R1 are connected together to form the second branch 24. The pilot transistor T5, which is configured as a diode, and the second transistor T2 of the core C1 are connected together to form the third branch 26.

The first core transistor T1 is connected to the second branch 24 between the resistance R1 and the second recopy transistor T3. The second transistor T2 of the core C1 is connected to the first branch 25 between the first recopy transistor T4 and the first transistor T1 of the core C1.

In the example in FIG. 2, the mirror transistors Mi are of the same type, in this case of the p-n-p type. The transistors of the core C1 are also of the same type, in this case of the n-p-n type. The core transistors are complementary to the mirror transistors.

The connections of the components in FIG. 2 will now be described in more detail. The resistance R1 has one of its ends connected to the supply terminal 21 at the potential $V_{ee}$, and its other end connected to the base of the first transistor T1 of the core C1 and to the collector of the second recopy transistor T3 of the mirror Mi. The second recopy transistor T3 has its emitter connected to the supply terminal 20 at the potential $V_{CC}$, and its base connected to the base of the pilot transistor T5 of the mirror Mi.

The first transistor T1 of the core C1 has its emitter connected to the supply terminal 21 at the potential $V_{ee}$, and its collector is connected to the collector of the first recopy transistor T4 of the mirror Mi and to the base of the second transistor T2 of the core C1. The base of the first recopy transistor T4 is connected to the base of the pilot transistor T5, and its emitter is connected to the supply terminal 20 at the potential $V_{CC}$.

The emitter of the second transistor T2 of the core C1 is connected to the supply terminal 21 at the potential $V_{ee}$, and its collector is connected to the collector of the pilot transistor T5. The emitter of the pilot transistor T5 is connected to the supply terminal at the potential $V_{CC}$, and because it is configured as a diode, its base and its collector are connected together.

The mirror Mi comprises, in addition, an output transistor T6 which enables the source current to be accessible. The output transistor T6 is a recopy transistor of the mirror Mi. It is configured as in the conventional current source of FIG. 1. Thus, its base is connected to the base of the pilot transistor T5, its emitter is connected to the supply terminal 20 at the potential $V_{CC}$ and its collector is intended to be connected to a current utilization device which is not shown.

Below are the current equations applicable to this current source. In the core, the current passing through the resistance R1 is of the first order, such that:

$$I=V_{BE}(T1)/R1$$

$$I=V_{T}\times\ln(I/Is)$$

Is represents the saturation current for the transistor T1. Taking into account the Early effect, the polarization current of the source, available at the level of the collector of the transistor T6, is such that:

$$Ic(T6)=I\times(1+(V_{CE}(T6)/V_{EA}(T6))/1+(V_{CE}(T5)/V_{EA}(T5))$$

$$Ic(T6)=I\times(1+(V_{CE}(T6)/V_{EA}(T6))/1+(V_{BE}(T5)/V_{EA}(T5))$$

When the supply voltage $V_{CC}$ varies, the current I will vary slightly due to the Early effects of the transistors T3 and T4. The transistor T6 will have the same Early effect as the transistor T3 which supplies the current to the resistance R1. Previously, the transistor which supplied the current to the resistance R was the transistor Q5, which was the pilot transistor of the mirror M. Thus one obtains:

$$Ic(T6)=I\times(1+(V_{CE}(T6)/V_{EA}(T6))/1+(V_{CE}(T3)/V_{EA}(T5))$$

$$Ic(T6)=I\times(1+(V_{CE}(T6)/V_{EA}(T6))/1+((V_{CC}-V_{BE}\ (T5))$$

A component (not shown) of the circuit to be supplied is intended to be connected between the collector of the output transistor T6 and the supply terminal 21 at the potential $V_{ee}$. The voltage $V_{CE}$(T6) can then be expressed in the same way as the voltage $V_{CE}$(T3), that is, in the form of a voltage difference $V_{CC}$ minus the voltage at the terminals of the component (not shown). Consequently, the two differences vary in the same way as a function of $V_{CC}$, and their ratio becomes almost constant and independent of $V_{CC}$.

The current Ic(T6) of the current source according to the invention is quasi-constant while the supply voltage varies. As far as the minimum supply voltage $V_{CCmin}$ is concerned, ensuring the start up of the current source for branch 24 is given by:

$$V_{CCmin}=V_{BE}(T1)+V_{CEsat}(T3)$$

For branch 25 one obtains:

$$V_{CCmin}=V_{BE}(T2)+V_{CEsat}(T4)$$

For branch 26 one has:

$$V_{CCmin}=V_{BE}(T5)+V_{CEsat}(T2)$$

$$V_{CCmin}=V_{BE}+V_{Cesat}.$$

This voltage $V_{CCmin}$ is on the order of one volt with bipolar transistors.

Figure 6:
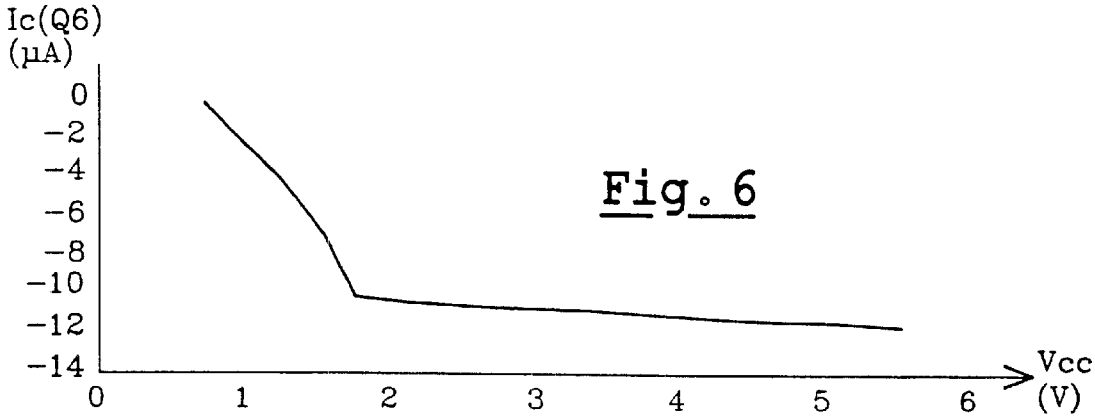
FIG. 6 is a diagram showing the source current of FIG. 1 as a function of the supply voltage $V_{CC}$.
Figure 7:
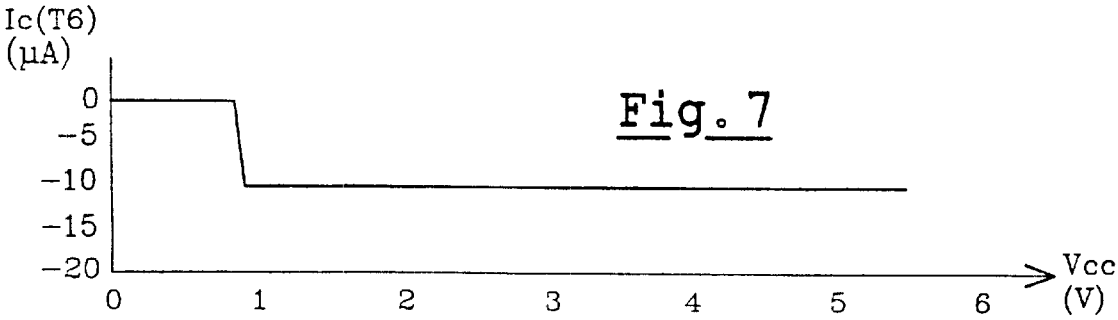
FIG. 7 is a diagram showing the current of the current source of FIG. 2 as a function of the supply voltage $V_{CC}$.

Reference is now made to FIGS. 6 and 7. In FIG. 6, with the source of FIG. 1, the current Ic(Q6) varies between −10 microamperes and −12 microamperes, whereas the supply voltage $V_{CC}$ varies between 1.7 volts and 6.5 volts. In FIG. 7, with the source of FIG. 2, the current Ic(T6) remains at about −10 microamperes, whereas the supply current $V_{CC}$ varies between 0.9 volts and 5.5 volts.

The start up is very clear. It corresponds to the straight portion of the graphs and begins at about 1.7 volts on FIG. 6 and about 0.9 volts on FIG. 7. The tests which made it possible to draw up the graphs of FIGS. 6 and 7 also show that the current Ic(Q6) varies by +3.4%/V whereas the current Ic(T6) only varies by +0.03%/V. The Early voltage of the n-p-n transistors was 75 volts, that of the p-n-p transistors was 62 volts, and the current I was about 10 microamperes.

Figure 3:
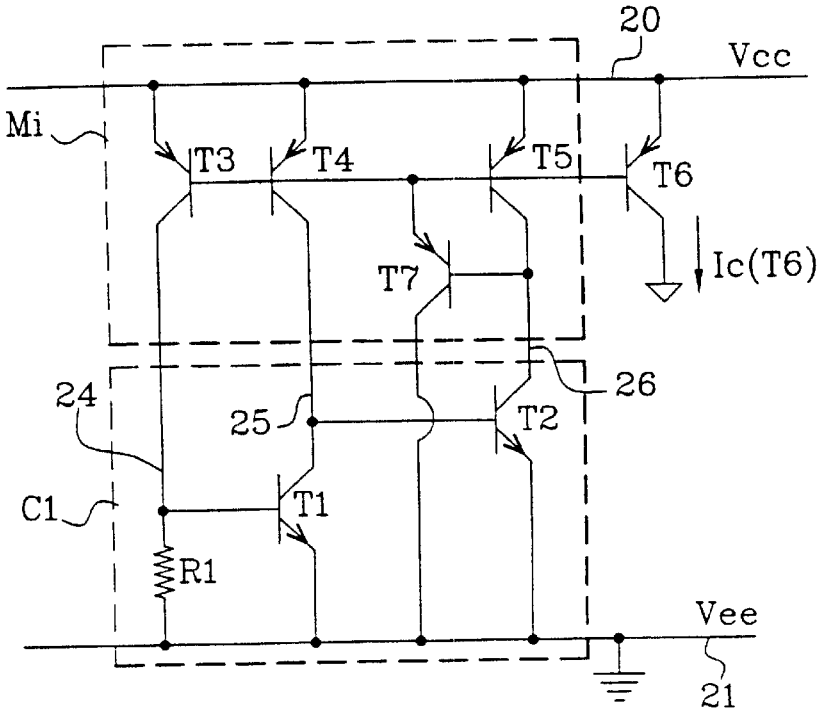
FIG. 3 is an electrical diagram of another example of a current source using bipolar transistors according to the present invention.
Figure 4:
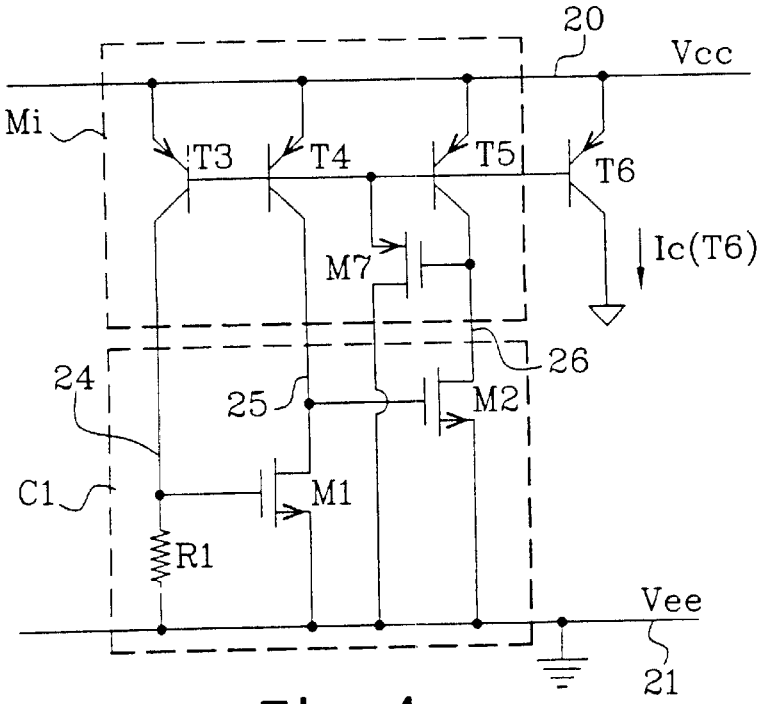
FIG. 4 is an electrical diagram of another example of a current source with the core using MOS transistors and the current mirror using bipolar transistors according to the present invention.

Reference is now made to FIG. 3. If the low start up voltage is no longer a restriction, it is possible to configure the pilot transistor T5 of the mirror Mi as a diode through an additional transistor T7. The additional transistor T7 is a p-n-p transistor like the other transistors of the mirror Mi. Its base is connected to the collector of the pilot transistor T5, its emitter is connected to the base of the pilot transistor T5, and its collector is connected to the supply terminal 21 at the potential $V_{ee}$. Instead of using a bipolar transistor of the same type as the mirror transistors T3 to T6, the additional transistor could be a MOS transistor. This variation is shown in FIG. 4.

The transistor T7 compensates the base currents of the transistors of the mirror Mi produced in bipolar technology. In this variation, the minimum supply voltage $V_{CCmin}$ to obtain start up becomes:

$$V_{CCmin}=V_{BE}(T5)+V_{BE}(T7)+V_{CEsat}(T2)$$

that is, $V_{CCmin}=2V_{BE}+V_{Cesat}$.

The configurations described above only contain bipolar transistors. It is possible for the core C1 to be made with MOS transistors as illustrated in FIG. 4. The mirror Mi is identical to that of FIG. 3 with the exception of the additional transistor, which now becomes a MOS transistor referenced as M7. This transistor may also be left out.

The core C1 comprises the resistance R1 and now two MOS transistors M1 and M2. The branches are comparable to those of FIG. 2. The drain of the transistor M1 is connected to the gate of the transistor M2 and to the collector of the transistor T4. The source of the transistor M1 is connected to the supply terminal 21 at the potential $V_{ee}$. The gate of the transistor M1 is connected to one of the ends of the resistance R1. The source of the transistor M2 is connected to the supply terminal 21 at the potential $V_{ee}$, and the drain of the transistor M2 is connected to the collector of the pilot transistor T5.

Figure 5:
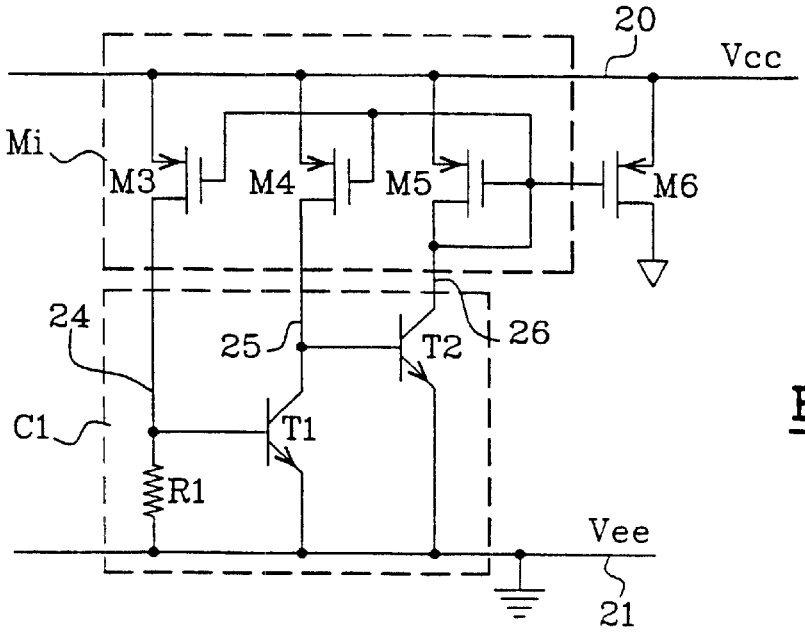
FIG. 5 is an electrical diagram of an example of a current source with the core using bipolar transistors and the current mirror using MOS transistors according to the present invention.

This current source is described as a source in $V_{GS}/R$ instead of being described as a source in $V_{BE}/R$. Another variation is shown in FIG. 5. Here, the mirror transistors Mi are MOS transistors whereas the core transistors C1 are bipolar as in FIG. 2.

The mirror Mi now comprises a pilot transistor M5, two recopy transistors M4 and M3 and an output transistor M6. The branches are comparable to those of FIG. 2. The second recopy transistor M3 has its source connected to the supply terminal 20 at the potential $V_{CC}$, its gate connected to the gate of the pilot transistor M5, and its drain connected to the resistance R1 of the core C1.

The gate of the first recopy transistor M4 is connected to the gate of the pilot transistor M5, its source is connected to the supply terminal 20 at the potential $V_{CC}$, and its drain connected to the collector of the transistor T1 of the core C1. The pilot transistor M5 has its source connected to the supply terminal at the potential $V_{CC}$ and because it is configured as a diode, its gate and its drain are connected together. Its drain is also connected to the collector of the transistor T2 of the core C1.

The output transistor M6 has its gate connected to the gate of the pilot transistor M5, its source connected to the supply terminal 20 at the potential $V_{CC}$, and its drain is intended to be connected to a utilization device not shown here. It is of course possible for the current source according to the invention to be made entirely in MOS technology by combining the core C1 of FIG. 4 and the mirror Mi of FIG. 5.

All the transistors described above may be replaced by their complements by reversing the supply terminals. The emitters or sources of the transistors which were connected to the supply terminal at the potential $V_{ee}$ would then be connected to the supply terminal at the potential Vcc and the inverse. As for the resistance R1, instead of being connected to the supply terminal at the potential $V_{ee}$ it would be connected to the supply terminal at the potential $V_{CC}$. The direction of the current at the level of the utilization device would thus be reversed.

That which is claimed is:

1. A current source comprising:

a current mirror connected to a first supply terminal, and comprising a pilot transistor, a first recopy transistor and a second recopy transistor all connected together;

a core connected to said current mirror and to a second supply terminal, and comprising a first transistor, a second transistor, and a resistance all connected together; and said current mirror and said core forming a plurality of branches between the first and second supply terminals, the plurality of branches comprising a first branch formed by said first transistor and said first recopy transistor connected together, a second branch formed by said resistance and said second recopy transistor connected together, and said first transistor is connected to the second branch between said resistance and said second recopy transistor, and a third branch formed by said pilot transistor and said second transistor connected together, with said second transistor connected to the first branch between said first transistor and said first recopy transistor.

2. A current source according to claim 1, further comprising an output transistor connected to said current mirror and to the first supply terminal for providing an output current.

3. A current source according to claim 2, wherein said output transistor is a supplementary recopy transistor of said current mirror.

4. A current source according to claim 1, wherein said pilot transistor and said first and second recopy transistors are of a same type.

5. A current source according to claim 1, wherein said first and second transistors are of a same type.

6. A current source according to claim 1, wherein said pilot transistor and said first and second recopy transistors are complementary to said first and second transistors.

7. A current source according to claim 1, wherein said pilot transistor and said first and second recopy transistors each comprises a bipolar transistor.

8. A current source according to claim 1, further comprising a supplementary transistor connected between said current mirror and the second supply voltage; and wherein said pilot transistor is configured as a diode through said supplementary transistor.

9. A current source according to claim 1, wherein said pilot transistor and said first and second recopy transistors each comprises a MOS transistor.

10. A current source according to claim 1, wherein said pilot transistor, said first and second recopy transistors and said first and second transistors each comprises a bipolar transistor.

11. A current source according to claim 1, wherein said first and second transistors each comprises a MOS transistor.

12. A current source according to claim 8, wherein said supplementary transistor comprises a bipolar transistor.

13. A current source according to claim 8, wherein said supplementary transistor comprises a MOS transistor.

14. A current source comprising:

a current mirror connected to a first supply terminal, and comprising a pilot transistor, a first recopy transistor and a second recopy transistor all connected together;

a core connected to said current mirror and to a second supply terminal, and comprising a first transistor, a second transistor, and a resistance all connected together;

an output transistor connected to said current mirror and to the first supply terminal for providing an output current; and said current mirror and said core forming a plurality of branches between the first and second supply terminals, the plurality of branches comprising a first branch formed by said first transistor and said first recopy transistor connected together, a second branch formed by said resistance and said second recopy transistor connected together, and a third branch formed by said pilot transistor and said second transistor connected together.

15. A current source according to claim 14, wherein said first transistor is connected to the second branch between said resistance and said second recopy transistor; and wherein said second transistor is connected to the first branch between said first transistor and said first recopy transistor.

16. A current source according to claim 14, wherein said output transistor is a supplementary recopy transistor of said current mirror.

17. A current source according to claim 14, wherein said first and second transistors are of a same type.

18. A current source according to claim 14, wherein said pilot transistor and said first and second recopy transistors are complementary to said first and second transistors.

19. A current source according to claim 14, wherein said pilot transistor and said first and second recopy transistors each comprises a bipolar transistor.

20. A current source according to claim 14, further comprising a supplementary transistor connected between said current mirror and the second supply voltage; and wherein said pilot transistor is configured as a diode through said supplementary transistor.

21. A current source according to claim 14, wherein said pilot transistor and said first and second recopy transistors each comprises a MOS transistor.

22. A current source according to claim 14, wherein said pilot transistor, said first and second recopy transistors and said first and second transistors each comprises a bipolar transistor.

23. A current source according to claim 14, wherein said first and second transistors each comprises a MOS transistor.

24. A method for making a current source comprising:

connecting a current mirror to a first supply terminal, the current mirror comprising a pilot transistor, a first recopy transistor and a second recopy transistor all connected together;

connecting a core to the current mirror and to a second supply terminal, the core comprising a first transistor, a second transistor, and a resistance all connected together;

connecting an output transistor to the current mirror and to the first supply terminal for providing an output current; and forming a plurality of branches between the first and second supply terminals by connecting the first transistor to the first recopy transistor to form a first branch, connecting the resistance to the second recopy transistor to form a second branch, and connecting the pilot transistor to the second transistor to form a third branch.

25. A method according to claim 24, further comprising:

connecting the transistor to the second branch between the resistance and the second recopy transistor; and connecting the second transistor to the first branch between the first transistor and the first recopy transistor.

26. A method according to claim 24, wherein the output transistor is a supplementary recopy transistor of the current mirror.

27. A method according to claim 24, wherein the first and second transistors are of a same type.

28. A method according to claim 24, wherein the pilot transistor and the first and second recopy transistors are complementary to the first and second transistors.

29. A method according to claim 24, wherein the pilot transistor and the first and second recopy transistors each comprises a bipolar transistor.

30. A method according to claim 24, further comprising connecting a supplementary transistor between the current mirror and the second supply voltage; and wherein the pilot transistor is configured as a diode through the supplementary transistor.

31. A method according to claim 24, wherein the pilot transistor and the first and second recopy transistors each comprises a MOS transistor.

32. A method according to claim 24, wherein the pilot transistor, the first and second recopy transistors and the first and second transistors each comprises a bipolar transistor.

33. A method according to claim 24, wherein the first and second transistors each comprises a MOS transistor.

* * * * *